US008272559B2

(12) United States Patent
Sutherland

(10) Patent No.: US 8,272,559 B2
(45) Date of Patent: Sep. 25, 2012

(54) PACKS AND METHODS OF ERECTING PACKS

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 136 days.

(21) Appl. No.: 12/601,770

(22) PCT Filed: May 29, 2008

(86) PCT No.: PCT/US2008/065018

§ 371 (c)(1),
(2), (4) Date: Apr. 19, 2010

(87) PCT Pub. No.: WO2008/150824

PCT Pub. Date: Dec. 11, 2008

(65) Prior Publication Data

US 2010/0224676 A1 Sep. 9, 2010

Related U.S. Application Data

(60) Provisional application No. 60/932,140, filed on May 29, 2007.

(51) Int. Cl.
*B65D 5/42* (2006.01)

(52) U.S. Cl. ..... 229/103.2; 206/784

(58) Field of Classification Search ..... 206/140, 206/151, 152, 153, 154, 155, 427, 784; 229/117.13, 229/103.2, 117.12

See application file for complete search history.

(56) References Cited

U.S. PATENT DOCUMENTS

| | | | | | |
|---|---|---|---|---|---|
| 3,157,309 | A | * | 11/1964 | Chidsey, Jr. et al. | 206/155 |
| 3,167,214 | A | * | 1/1965 | Mahon | 206/155 |
| 3,398,856 | A | * | 8/1968 | Graser | 206/155 |
| 3,652,005 | A | * | 3/1972 | Morgese | 206/434 |
| 4,215,781 | A | * | 8/1980 | Humphries et al. | 206/434 |
| 4,596,713 | A | * | 6/1986 | Burdette | 426/107 |
| 5,094,347 | A | | 3/1992 | Schuster | |
| 5,163,607 | A | * | 11/1992 | Kuhn et al. | 206/427 |
| 5,351,878 | A | * | 10/1994 | Cooper | 206/427 |
| 5,551,556 | A | * | 9/1996 | Sutherland | 206/147 |
| 5,620,094 | A | | 4/1997 | Naumann | |
| 5,638,956 | A | | 6/1997 | Sutherland | |
| 5,807,597 | A | * | 9/1998 | Barnes et al. | 426/234 |
| 7,766,181 | B2 | * | 8/2010 | Fogle et al. | 229/404 |
| 2006/0237520 | A1 | | 10/2006 | Cargile, Jr. | |

FOREIGN PATENT DOCUMENTS

KR 20-0345529 3/2004

OTHER PUBLICATIONS

Supplementary European Search Report for EP 08 75 6399, mailed Mar. 2, 2011.
International Search Report in PCT/US2008/065018, dated Nov. 25, 2008.
Written Opinion in PCT/US2008/065018, dated Nov. 25, 2008.

* cited by examiner

*Primary Examiner* — J. Gregory Pickett
*Assistant Examiner* — Andrew Perreault
(74) *Attorney, Agent, or Firm* — Womble Carlyle Sandridge & Rice, LLP

(57) ABSTRACT

A pack includes a top panel, side panels, bottom panels, and retaining structures at each end of the pack. A packet can be disposed on a top surface of a container enclosed within the pack.

13 Claims, 8 Drawing Sheets

PACKS AND METHODS OF ERECTING PACKS

PRIORITY APPLICATION

This application is a National Phase application of International Application No. PCT/US2008/065018, filed May 29, 2008, which claims the benefit of Provisional Application No. 60/932,140, filed May 29, 2007, the entire contents of which are hereby incorporated by reference.

SUMMARY

According to one embodiment of the invention, a method of erecting a pack comprises: providing a blank comprising a top panel, at least one bottom panel, a first side panel and a second side panel, a first retaining structure at a first end of the blank; and a second retaining structure at a second end of the blank; placing a packet on the top panel; placing a container on the packet; and at least partially closing the blank around the container to form a carton, such that the first retaining structure at least partially extends across a first end of the carton and the second retaining structure at least partially extends across a second end of the carton.

According to another embodiment of the invention, a method of erecting a pack comprises: providing a blank comprising a top panel, a first side panel and a second side panel, a first bottom panel and a second bottom panel, a first retaining structure at a first end of the blank, and a second retaining structure at a second end of the blank; placing a container on the blank; moving the first retaining structure with respect to a remainder of the blank to engage an upper portion of the container; moving the second retaining structure with respect to a remainder of the blank to engage the upper portion of the container; at least partially wrapping the first side panel, the second side panel, the first bottom panel and the second bottom panel around the container; and connecting the first bottom panel to the second bottom panel, wherein the first retaining structure at least partially extends across a first end of the pack, and wherein the second retaining structure at least partially extends across a second end of the pack.

According to another embodiment of the invention, a pack comprises: a top panel; at least one bottom panel; a first side panel at a first side of the pack; a second side panel at a second side of the pack; a first retaining structure at a first end of the pack; a second retaining structure at a second end of the pack; a container, wherein the top panel, the at least one bottom panel, and the side panels are wrapped around the container; and a flexible vessel abutting the container and the top panel.

According to yet another embodiment of the invention, a pack comprises: a top panel; at least one bottom panel; a first side panel at a first side of the pack; a second side panel at a second side of the pack; a container, wherein the top panel, the at least one bottom panel, and the side panels are wrapped around the container; a first retaining structure at least partially extending across a first end of the pack, wherein the first retaining structure comprises a first plurality of panels, at least one of the first plurality of panels engaging an upper portion of the container; and a second retaining structure at least partially extending across a second end of the pack, wherein the second retaining structure comprises a second plurality of panels, at least one of the second plurality of panels engaging the upper portion of the container.

Other aspects, features, and details of the present invention can be more completely understood by reference to the following detailed description, taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
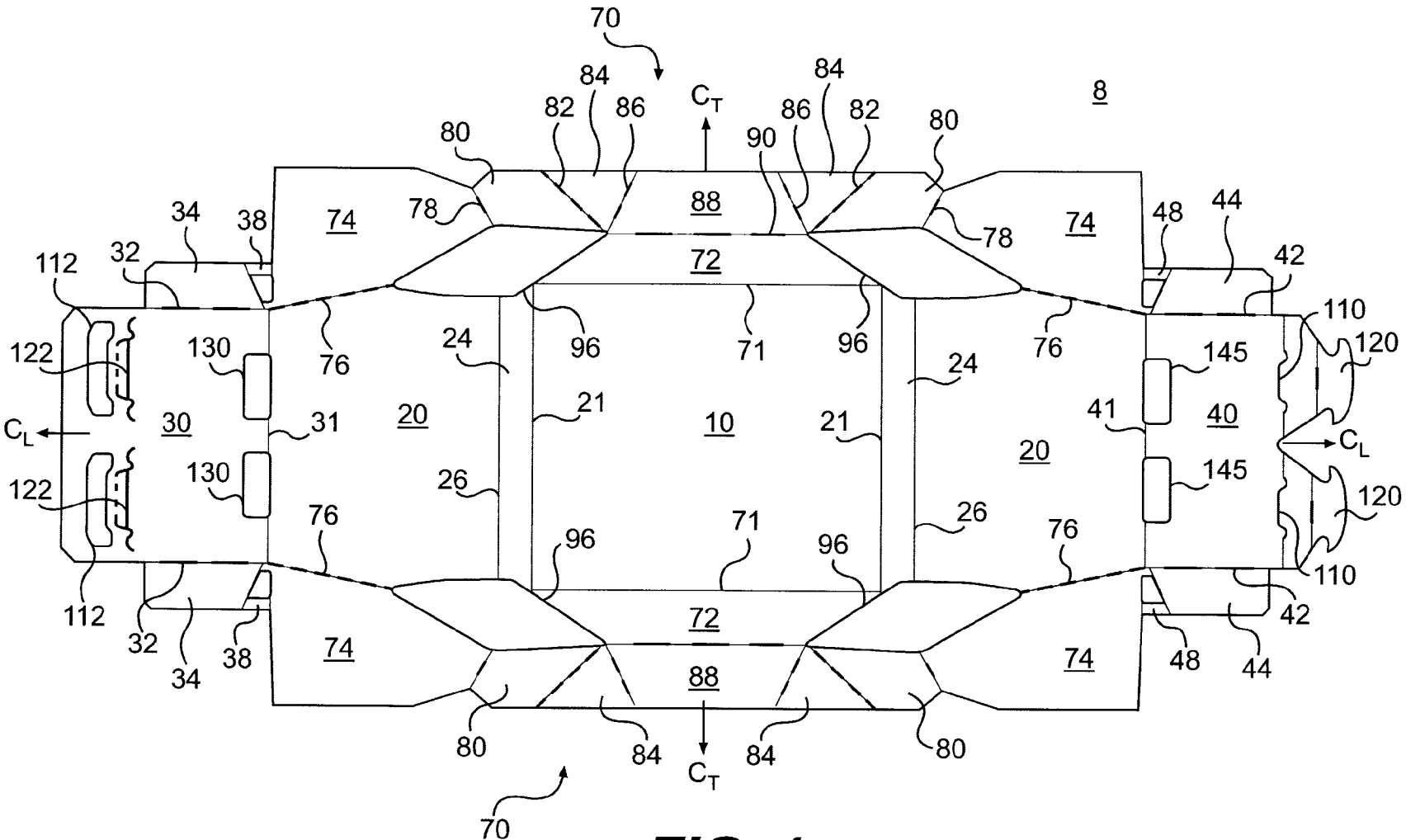
FIG. 1 is a plan view of the underside of a blank used to form a pack according to a first embodiment of the invention.

FIG. 1 a plan view of the underside or interior side of a blank 8 used to form a pack 160 (illustrated in FIGS. 7 and 8) according to a first embodiment of the invention. In FIG. 1, the print or exterior side of the blank 8 is face down. As shown in FIG. 1, the blank 8 may be wholly or partially symmetric about a longitudinal centerline $C_L$, and partially symmetric about a transverse centerline $C_T$. Therefore, certain elements in the drawing figures share common reference numerals in order to reflect the whole and/or partial longitudinal and transverse symmetries. In this specification, the terms "lower," "bottom," "side," "upper," "end" and "top" are used to indicate orientations determined in relation to fully erected packs placed in upright configurations.

For the purposes of illustration and not for the purpose of limiting the scope of the invention, the following detailed description describes a generally frustoconical plastic tub container disposed within the exemplary pack embodiment. Other types of containers not illustrated, and other articles, for example, may be accommodated in packs constructed, loaded and erected according to the principles of the present invention.

Referring to FIG. 1, the blank 8 comprises a top panel 10 foldably connected at each end to a top edge of a side panel 20 at a transverse fold line 21, a first bottom panel 30 foldably connected to a first side panel 20 at an interrupted transverse fold line 31, and a second bottom panel 40 foldably connected to the second side panel 20 at an interrupted transverse fold line 41. The first and second side panels 20 can include upper bevel sections 24 defined in part by pairs of spaced transverse fold lines 21, 26.

According to one aspect of the invention, retaining structures 70 at each end of the blank 8 serve to at least partially close the ends of the pack 160 (FIGS. 7 and 8) and/or to retain containers C or other articles within the pack 160. Viewing FIG. 1 from left to right, each retaining structure 70 comprises a first bottom end panel 34 foldably connected to an end of the first bottom panel 30 at a longitudinal fold line 32, a first connecting panel 38 foldably connected to the bottom end panel 34, a first side tuck-in panel 74 foldably connected to the connecting panel 38, and to an adjacent side panel 20 at an oblique fold line 76, a first side gusset panel 80 foldably connected to the first side tuck-in panel 74 at an oblique fold line 78, a first upper gusset panel 84 foldably connected to the first side gusset panel 80 at an oblique fold line 82, a distal upper end panel 88 foldably connected to the first upper gusset panel 84 at an oblique fold line 86, a second upper gusset panel 84 foldably connected to the distal upper end panel 88 at an oblique fold line 86, a second side gusset panel 80 foldably connected to the second upper gusset panel 84 at an oblique fold line 82, a second side tuck-in panel 74 foldably connected to the second side gusset panel 80 at an oblique fold line 78 and to an adjacent side panel 20 at an oblique fold line 76, a second connecting panel 48 foldably connected to the second side tuck-in panel 74, a second bottom end panel 44 foldably connected to the second connecting panel 48 and also foldably connected to one end of the second bottom panel 40 at a longitudinal fold line 42, and a proximal upper end panel 72 foldably connected the top panel 10 at a longitudinal fold line 71 and to the distal upper end panel 88 at a longitudinal fold line 90. Cut outs or apertures 96 are struck from the blank 8 at each corner of the top panel 10 and bordering interior edges of adjacent panels 74, 80 of the retaining structures 70.

The first bottom panel 30 includes cut outs struck from the blank 8 that form primary female locking edges 112 that are adapted to engage primary male locking tabs 110 of the second bottom panel 40. The first bottom panel 30 also includes slits 122 adapted to receive secondary male locking flaps 120 extending from the end of the second bottom panel 40. The transverse fold line 31 may be interrupted by apertures 130 struck from the first bottom panel 30, and the transverse fold line 41 may be interrupted by apertures 145 struck from the second bottom panel 40.

The fold lines 21, 26, 31, 32, 41, 42, 71, 76, 78, 82, 86, 90 formed in the blank 8 may be, for example, scores, creases, cuts, cut-space lines, cut-crease lines, overlapping and/or sequential combinations thereof, or other lines of disruption that facilitate folding, bending and/or erection of the blank 8. In the illustrated exemplary embodiment, the fold lines 21, 26, 31, 41, 71 are crease lines and the fold lines 32 42, 76, 78, 82, 86, 90 are cut-crease lines.

An exemplary method of erection of the pack 160 is discussed below with reference to FIGS. 1-6.

Figure 2:
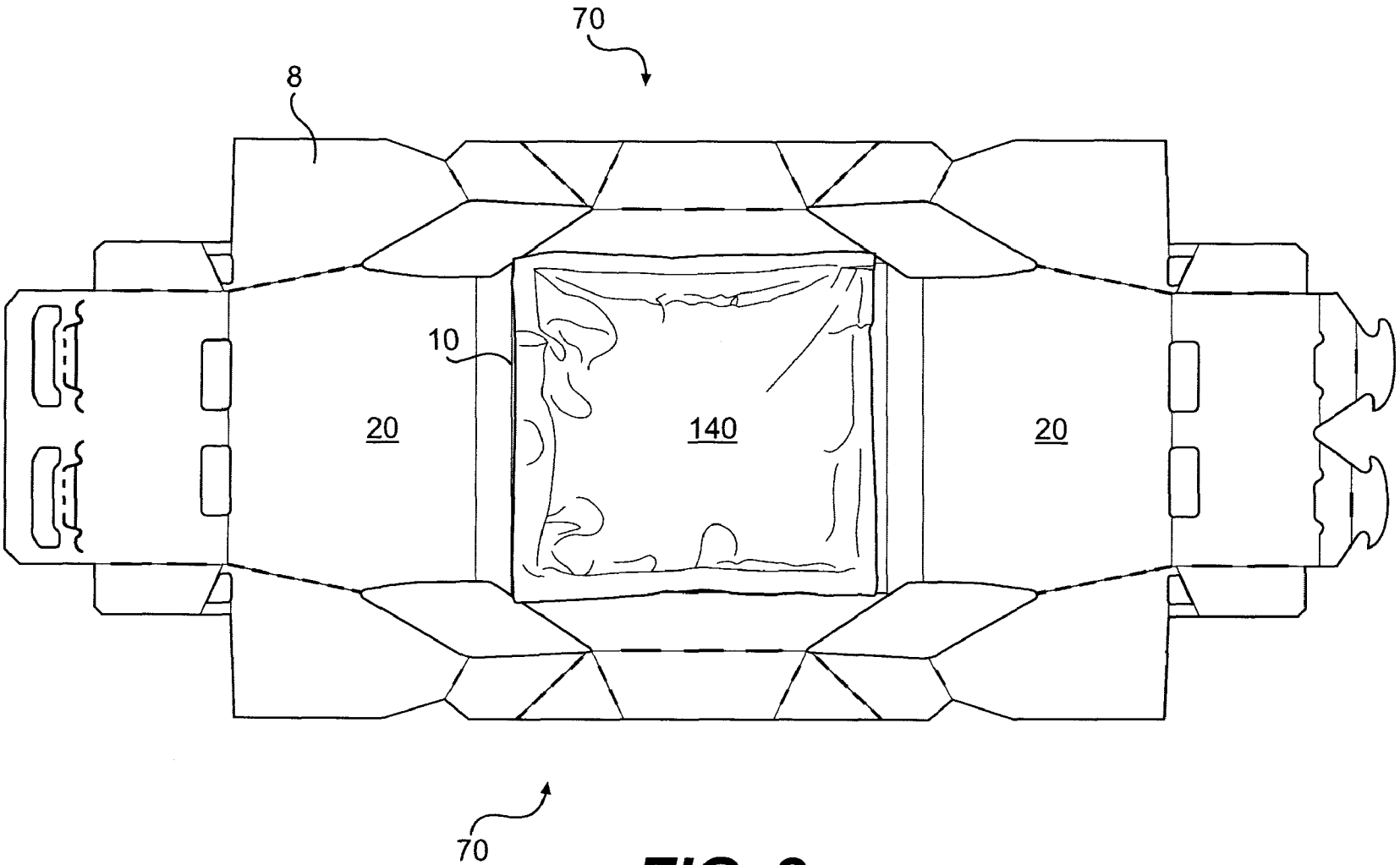
FIGS. 2-6 illustrate erection steps of the pack according to the first embodiment of the invention.
Figure 3:
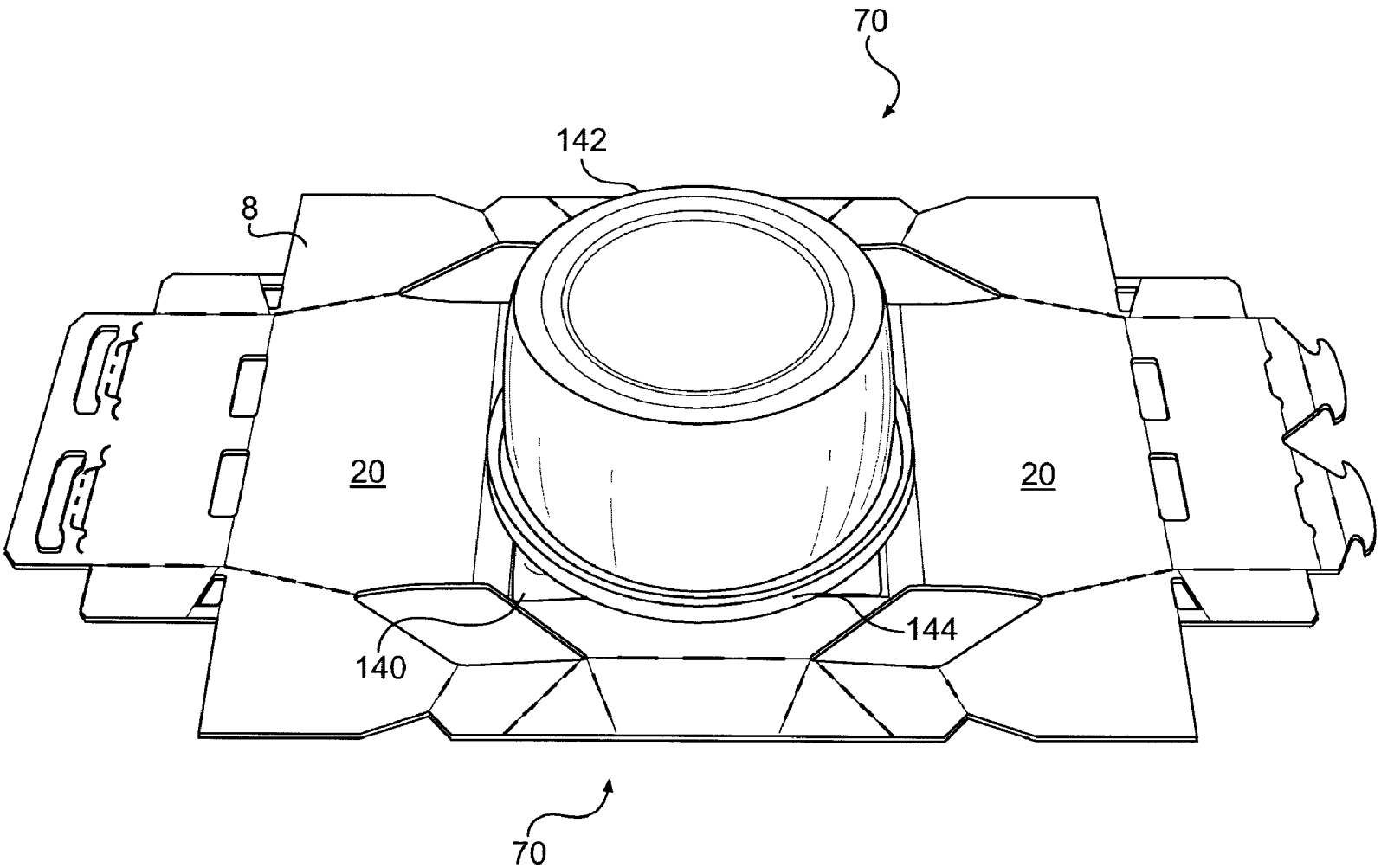

Referring to FIG. 2, a flexible vessel such as a packet or pouch 140 is placed on the underside or interior side of the blank 8 at the top panel 10. The exemplary pouch 140 has a generally rectangular plan shape when viewed from above. Referring to FIG. 3, a container 142 is placed topside down on the packet 140. In the illustrated embodiment, the container 142 is a generally frustoconical or cylindrical tub having a rim 144 which may be in the form of a container lid. The container 142 is placed on the pouch 140 so that the rim 144 of the container rests on the pouch. Other container forms and orientations may be used. The blank 8 may now be wrapped around the container 142.

Figure 4:
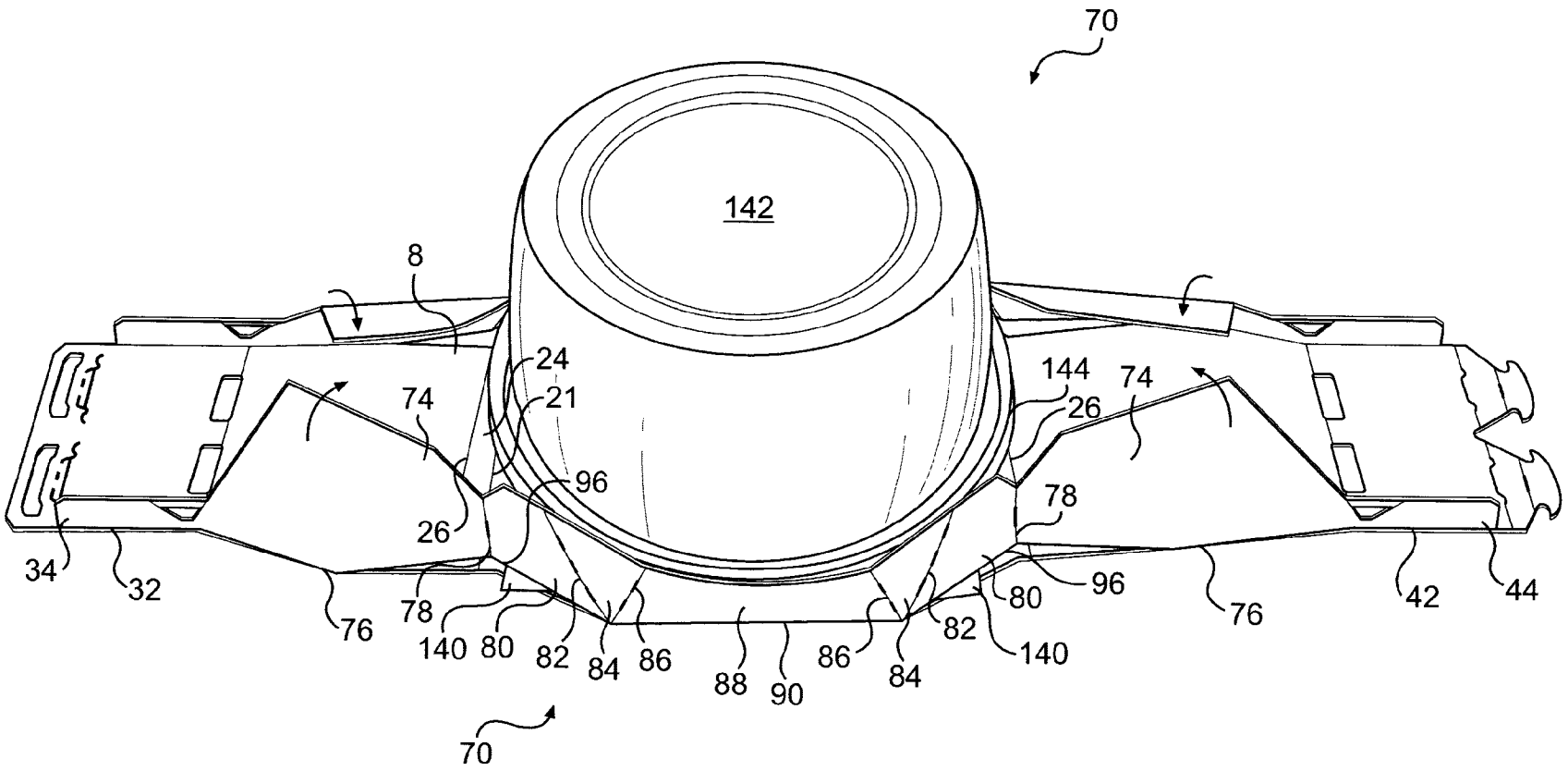

Referring to FIG. 4, the retaining structures 70 at each end of the blank 8 are drawn up around the sides of the container 142 and around the packet 140. The retaining structures 70 fold upwardly with respect to the remainder of the blank 8 at the fold lines 32, 76, 90, 76, 42. The interior surfaces of the panels 80, 84, 88, 84, 80 may thereby come to abut the container 142. The retaining structures 70 may also come to conform with an exterior surface of the container 142 by deforming at the fold lines 78, 82, 86, 86, 82, 78. One or more corners of the packet 140 may, for example, extend through one or more of the apertures 96.

Figure 5:
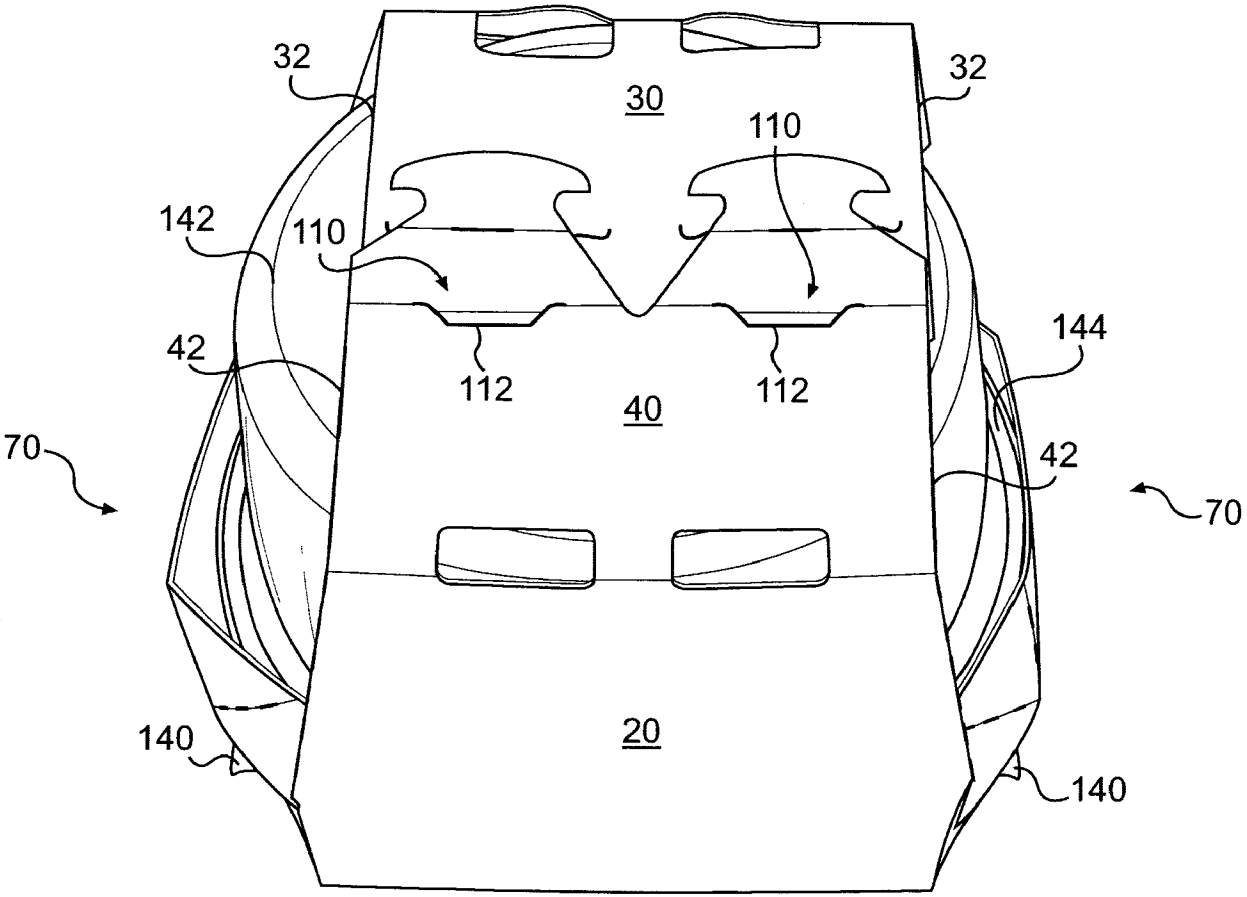

Referring to FIGS. 4 and 5, the partially erected carton can be closed by pivoting the side panels 20 upward about the fold lines 21, 26 so that the side panels 20 extend alongside or adjacent to the side of the container 142. The upper bevel sections 24 of the side panels 20 may, for example, bend out of plane at the fold lines 21, 26 with respect to the remainder of the side panels 20 and the top panel 10. As the side panels 20, and the attached bottom panels 30, 40, are pivoted upwardly, the first and second bottom end panels 34, 44 (illustrated in FIG. 1) are pivoted inwardly about the longitudinal fold lines 32, 42, respectively, so that they are adjacent to the respective bottom panels 30, 40. The first and second bottom end panels 34, 44 are thereby also brought into contact with the bottom of the container 142.

Still referring to FIG. 5, the first and second bottom panels 30, 40 are secured together by engaging the primary male locking tabs 110 of the second bottom panel 40 with the primary female locking edges 112 of the first bottom panel 30.

Figure 6:
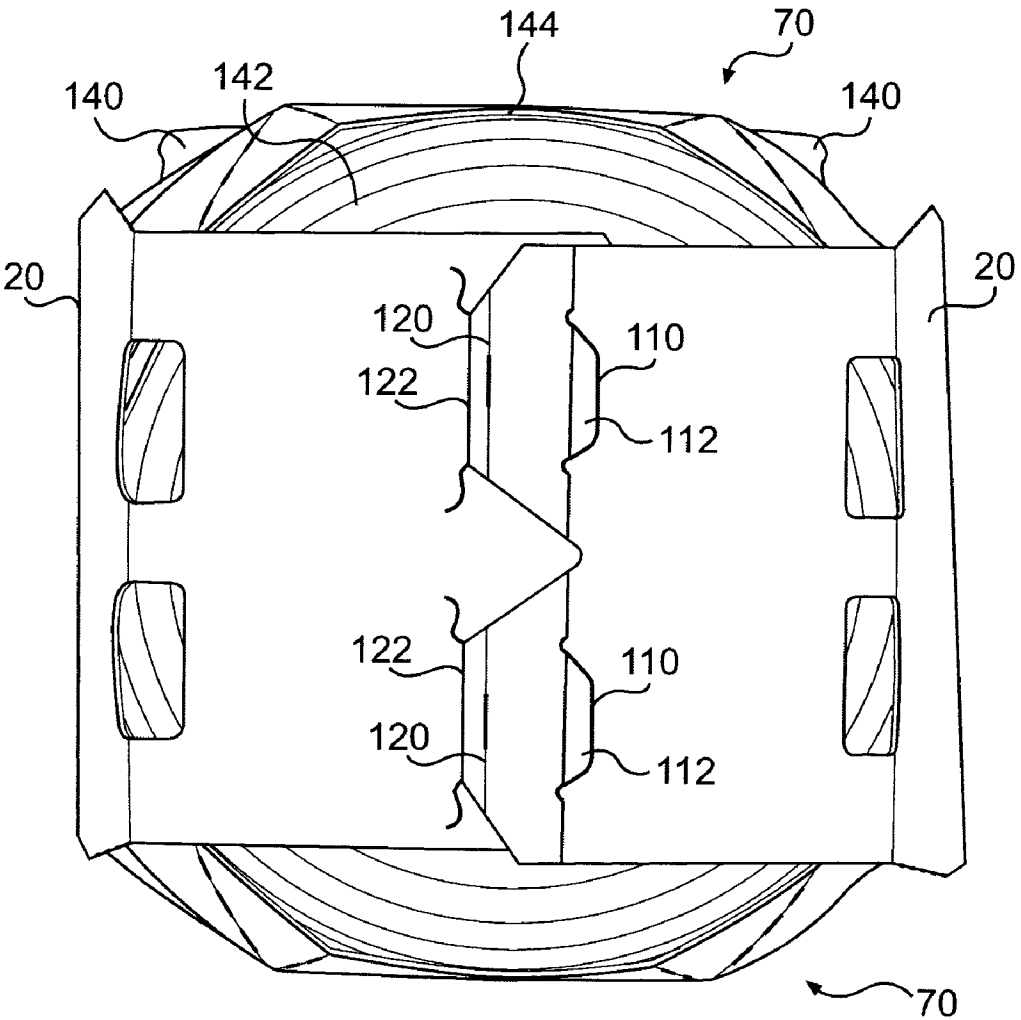
Figure 7:
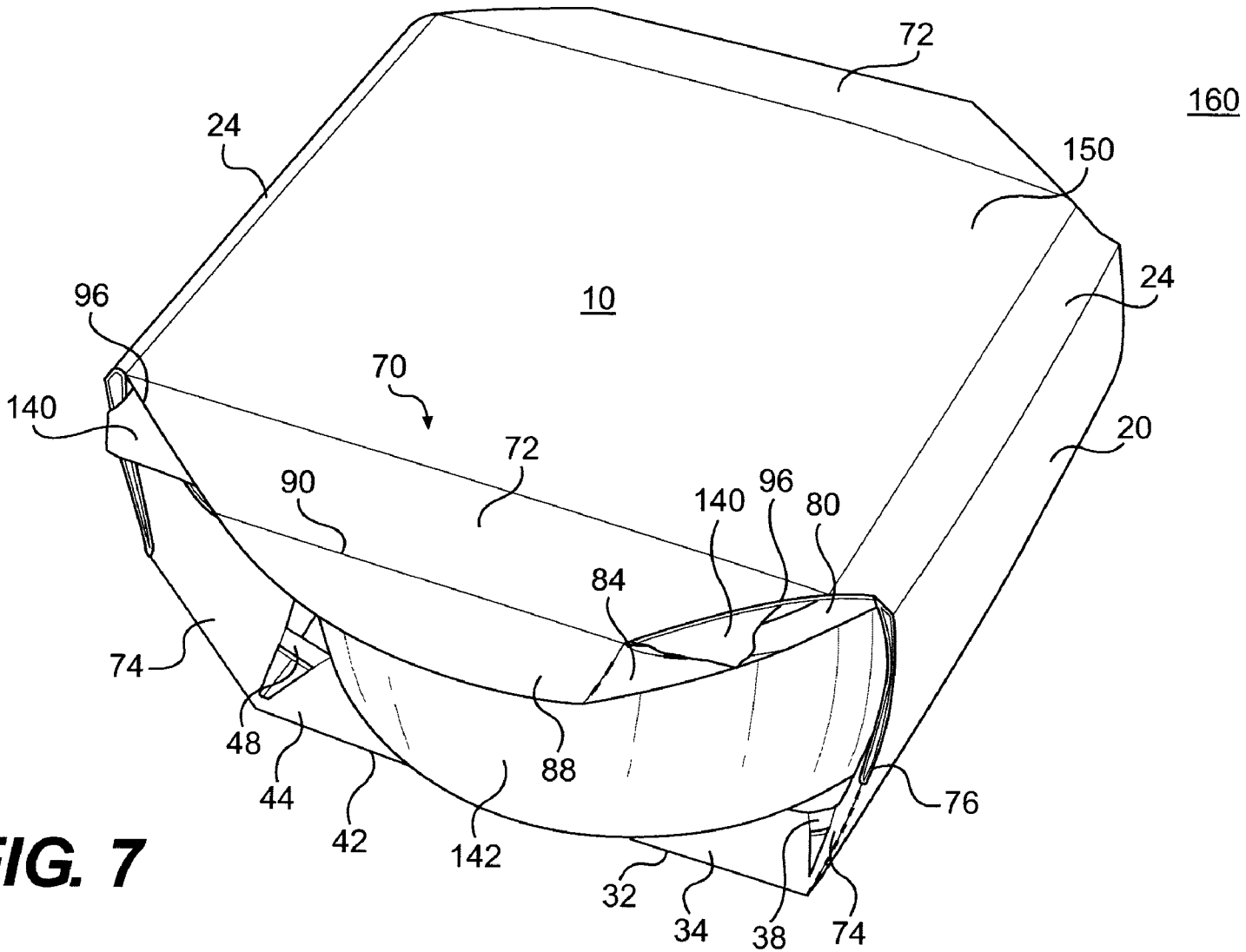
FIGS. 7 and 8 illustrate the pack according to the first embodiment of the invention.

Referring to FIG. 6, the secondary male locking flaps 120 of the second bottom panel 40 are pressed into the slits 122 of the first bottom panel 30. Engaging the primary and secondary locks releasably secures the first and second bottom panels 30, 40 together and completes erection of the pack 160, as illustrated in FIG. 7. The pack 160 comprises the erected blank 8, now in the form of a carton 150, wrapped around the container 142 and the flexible vessel 140.

Figure 8:
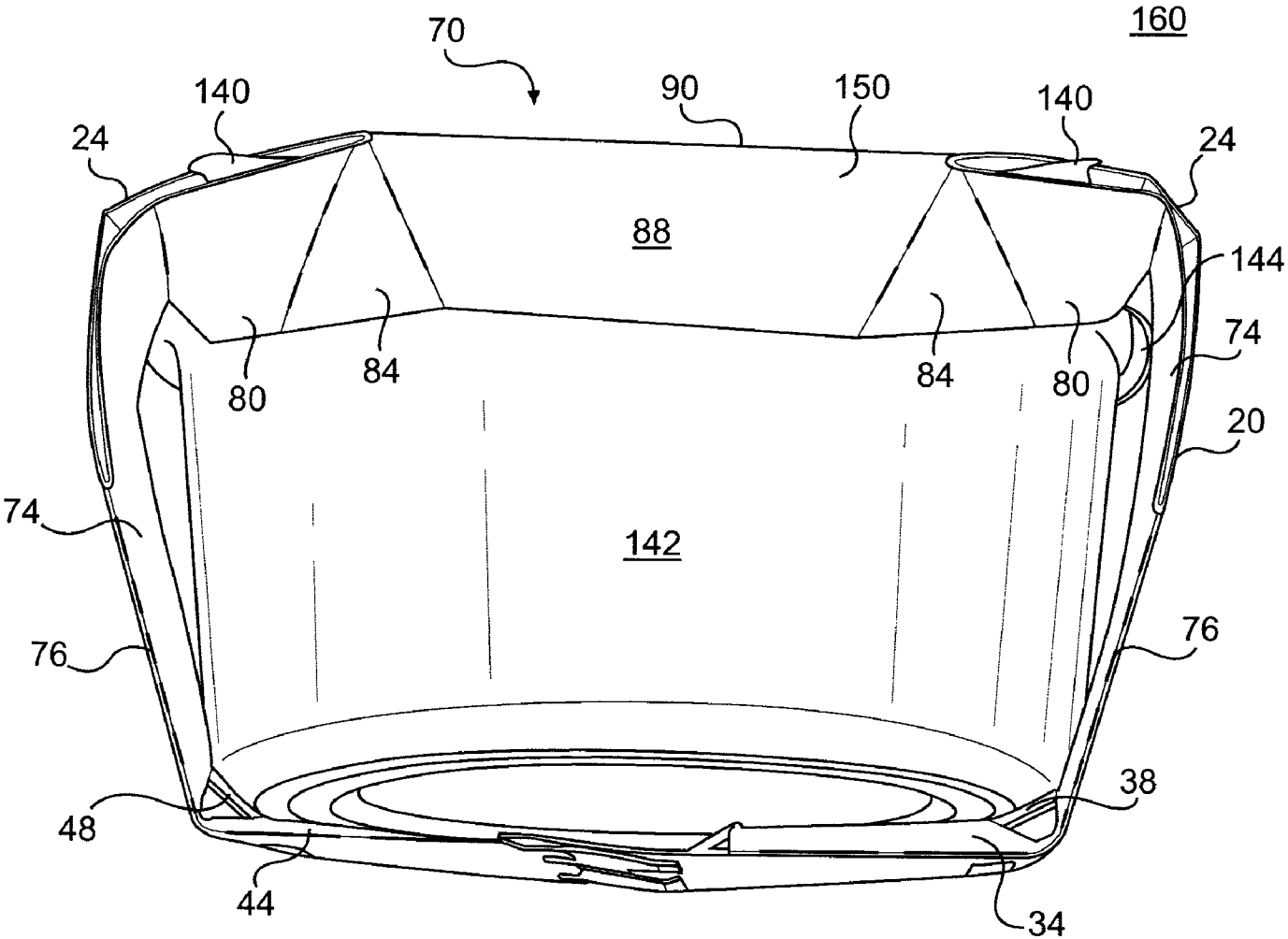

Referring to FIGS. 7 and 8, the retaining structures 70 on each side of the carton 150 retain the packet 140 and upper and side sections of the container 142, including the lid 144, within the carton. Corners of the packet 140, which rests on the upper surface of the rim or lid 144 of the container 142, can, for example, extend through one or more of the apertures 96 in the carton 150. The bottom of the tub container 142 may rest on the two bottom end panels 34, which are folded inwardly about the longitudinal fold lines 32, and the two bottom end panels 44, which are folded inwardly about the longitudinal fold lines 42.

Referring specifically to FIG. 8, the side tuck-in panels 74 press inwardly and/or abut against the side of the container 142, while the gusset panels 80, 84 and the upper panel 88 deform so that they partially conform to and wrap around the upper portion of the container. The connecting panels 38 connect adjacent first bottom end panels 34 and first side tuck-in panels 74, and the connecting panels 48 connect adjacent second bottom end panels 44 and second side tuck-in panels 74. If a rim 144 is provided with the container 142, such as in the form of a removable container top, the panels 80, 84, 88 can engage an underside of the rim 144 to further secure the container in place.

Referring to FIG. 8, the bevel panels 24 may fold or bend at the transverse fold lines 21, 26 and extend obliquely across an upper corner of the pack 160, out of plane with the top panel 10 and the side panels 20.

In the illustrated embodiments, cutout sections or apertures, such as the apertures 96, 130, 145 struck from the blank 8, may alternatively be formed from knockout sections that are removed, for example, before or during erection of the blank.

In the exemplary embodiment, the flexible vessel 140 is a foil packet with a food item enclosed therein. The packet 140 is relatively thin in cross-section, when viewed from the side, and may be a flexible, waterproof vessel. According to other embodiments, the packet 140 could be made of a pliable material other than foil, such as paper or plastic.

In accordance with the exemplary embodiments, the blank may be constructed of paperboard of a caliper such that it is heavier and more rigid than ordinary paper. The blank can also be constructed of other materials, such as cardboard or any other material having properties suitable for enabling the pack to function at least generally as described above.

The blank can be laminated to or coated with one or more sheet-like materials at selected panels or panel sections. Interior and/or exterior sides of the blank can be coated with a clay coating. The clay coating may then be printed over with product, advertising, price coding, and other information or images. The blank may then be coated with a varnish to protect information printed on the blank. The blank may also be coated with, for example, a moisture barrier layer, on either or both sides of the blank.

In accordance with the exemplary embodiments, a fold line can be any substantially linear, although not necessarily straight, form of disruption or weakening in the blank that facilitates full or partial bending or folding therealong. More specifically, but not for the purpose of narrowing the scope of the present disclosure, examples of fold lines include: score lines; crease lines; cut-crease lines; cut-score lines; cut-space lines; and various overlapping and/or sequential combinations of these features.

For purposes of the description presented herein, the term "line of disruption" or "line of weakening" can be used to generally refer to, for example, cuts, scores, creases, tear lines, or fold lines (or combinations thereof) formed in a blank.

In the present specification, a "panel" or "flap" need not be flat or otherwise planar. A "panel" or "flap" can, for example, comprise a plurality of interconnected generally flat or planar sections.

The term "line" as used herein includes not only straight lines, but also other types of lines such as curved, curvilinear or angularly displaced lines.

The term "foldably" is used to describe general folding or bending between connected panels. The term does not imply the ability to fold to a large degree, such as, for example, a ninety degree or one hundred eighty degree fold.

The above embodiments may be described as having one or panels adhered together by glue during erection of the carton embodiments. The term "glue" is intended to encompass all manner of adhesives commonly used to secure carton panels in place.

The description is not intended to limit the disclosure to the form disclosed herein. Also, it is intended that the appended claims be construed to include alternative embodiments, not explicitly defined in the detailed description.

What is claimed is:

1. A method of erecting a pack, comprising:

obtaining a blank, the blank comprising:

a top panel;

at least one bottom panel;

a first side panel;

a second side panel;

a first retaining structure at a first end of the blank, two first apertures being formed in the blank adjacent to the first retaining structure; and a second retaining structure at a second end of the blank, two second apertures being formed in the blank adjacent to the second retaining structure;

placing a packet on the top panel;

placing a container on the packet, an upper portion of the container comprising a rim; and at least partially closing the blank around the container to form a carton, such that the first retaining structure at least partially extends across a first end of the carton and the second retaining structure at least partially extends across a second end of the carton, wherein at least one of the first retaining structure and the second retaining structure engages an underside of the rim of the container, and wherein at least a portion of the packet extends through at least one of the two first apertures and the two second apertures after the at least partially closing the blank around the container.

2. The method of claim 1, wherein the at least one bottom panel comprises a first bottom panel and a second bottom panel, the method further comprising connecting the first bottom panel to the second bottom panel.

3. The method of claim 1, wherein the first retaining structure comprises a first plurality of panels, and wherein at least partially closing the blank around the container comprises engaging at least one of the first plurality of panels with the upper portion of the container.

4. The method of claim 3, wherein the first plurality of panels comprises a first bottom end panel connected to the first bottom panel and a second bottom end panel connected to the second bottom panel, and wherein at least partially closing the blank around the container comprises folding the first bottom end panel and the second bottom end panel inwardly toward the at least one bottom panel so that a bottom of the container rests on the first and second bottom end panels.

5. The method according to claim 1, wherein the first retaining structure comprises a distal upper end panel, and wherein at least partially closing the blank around the container comprises engaging the distal upper end panel with the underside of the rim of the container.

6. The method according to claim 3, wherein the first retaining structure comprises a first side tuck-in panel and a second side tuck-in panel, and wherein at least partially closing the blank around the container comprises tucking the first side tuck-in panel inwardly so that it is disposed between the first side panel and the container.

7. A pack, comprising:

a top panel;

at least one bottom panel;

a first side panel at a first side of the pack;

a second side panel at a second side of the pack;

a first retaining structure at a first end of the pack, at least one first aperture being formed in the pack adjacent to the first retaining structure;

a second retaining structure at a second end of the pack, at least one second aperture being formed in the pack adjacent to the second retaining structure;

a container, an upper portion of the container comprising a rim, wherein the top panel, the at least one bottom panel, and the side panels are wrapped around the container, and at least one of the first retaining structure and the second retaining structure engages an underside of the rim of the container; and a flexible vessel abutting the container and the top panel, at least a portion of the flexible vessel extending through at least one of the at least one first aperture and the at least one second aperture.

8. The pack of claim 7, wherein the first retaining structure comprises a first plurality of panels, at least one of the first plurality of panels engaging the underside of the rim of the container.

9. The pack of claim 8, wherein the first plurality of panels comprises a first bottom end panel connected to the first bottom panel and a second bottom end panel connected to the second bottom panel, and wherein a bottom of the container rests on the first and second bottom end panels.

10. The pack according to claim 8, wherein the first plurality of panels comprises a proximal upper end panel foldably connected to an end of the top panel and a distal upper end panel foldably connected to the proximal upper end panel, the distal upper end panel engaging the underside of the rim of the container.

11. The pack according to claim 7, wherein the flexible vessel rests on the upper portion of the container.

12. The pack of claim 7, wherein the at least one bottom panel comprises a first bottom panel and a second bottom panel connected to the first bottom panel.

13. The pack of claim 7, wherein flexible vessel comprises a packet containing a food item.

* * * * *